US008286551B2

(12) United States Patent
Gygi

(10) Patent No.: US 8,286,551 B2
(45) Date of Patent: Oct. 16, 2012

(54) PRINTING MACHINE

(75) Inventor: Matthias Gygi, Montreux (CH)

(73) Assignee: KBA-NotaSys SA, Lausanne (CH)

( * ) Notice: Subject to any disclaimer, the term of this patent is extended or adjusted under 35 U.S.C. 154(b) by 0 days.

(21) Appl. No.: 12/847,499

(22) Filed: Jul. 30, 2010

(65) Prior Publication Data

US 2011/0017081 A1 Jan. 27, 2011

Related U.S. Application Data

(63) Continuation of application No. 10/561,748, filed as application No. PCT/IB2004/002144 on Jun. 29, 2004.

(30) Foreign Application Priority Data

Jun. 30, 2003 (EP) ..... 03014827

(51) Int. Cl.
*B41L 13/04* (2006.01)

(52) U.S. Cl. ..... 101/116; 101/491

(58) Field of Classification Search ..... 101/389.1, 101/489, 490, 115, 116, 119, 120, 129, 491
See application file for complete search history.

(56) References Cited

U.S. PATENT DOCUMENTS

| | | | |
|---|---|---|---|
| 3,526,191 | A | 9/1970 | Silverberg |
| 3,530,794 | A | 9/1970 | Ritzerfeld |
| 3,581,257 | A | 5/1971 | Priessnetz |
| 3,592,132 | A | 7/1971 | Weber |
| 3,998,160 | A | 12/1976 | Pearce |
| 4,186,944 | A | 2/1980 | Pearce |
| 4,443,579 | A | 4/1984 | Doin et al. |
| 5,018,445 | A | 5/1991 | Six |
| 5,075,700 | A | 12/1991 | Kondo |
| 5,151,712 | A | 9/1992 | Arahara et al. |
| 5,196,893 | A | 3/1993 | Nishise et al. |
| 5,213,042 | A | 5/1993 | Larios |
| 5,247,317 | A | 9/1993 | Corver et al. |
| 5,339,731 | A | 8/1994 | Howard et al. |
| 5,364,689 | A | 11/1994 | Kashiwagi et al. |
| 5,630,877 | A | 5/1997 | Kashiwagi et al. |
| 5,847,567 | A | 12/1998 | Kielb et al. |
| 5,853,197 | A | 12/1998 | Mowry, Jr. et al. |
| 5,889,544 | A | 3/1999 | Mey et al. |
| 6,050,606 | A | 4/2000 | Foresti |
| 6,082,778 | A | 7/2000 | Solmsdorf |
| 6,103,361 | A | 8/2000 | Batzar et al. |
| 6,668,718 | B2 | 12/2003 | van den Brink et al. |
| 6,875,522 | B2 | 4/2005 | Seto et al. |
| 7,047,883 | B2 | 5/2006 | Raksha et al. |
| 2002/0160194 | A1 | 10/2002 | Phillips et al. |
| 2002/0166470 | A1 | 11/2002 | Nedblake, Jr. et al. |
| 2002/0182383 | A1 | 12/2002 | Phillips et al. |

FOREIGN PATENT DOCUMENTS

| | | |
|---|---|---|
| EP | 0 710 508 | 5/1996 |
| EP | 1 134 752 | 9/2001 |
| EP | 1 239 307 | 9/2002 |
| IT | 1240424 | 12/1993 |
| JP | 6-76283 | 3/1994 |
| WO | 03/000801 | 1/2003 |

*Primary Examiner* — Ren Yan
(74) *Attorney, Agent, or Firm* — Seager, Tufte & Wickhem, LLC

(57) ABSTRACT

The printing machine comprises at least one transfer system for conveying a substrate onto an impression cylinder and at least one screen of cylindrical or flat shape, with a doctor blade, said screen collaborating with the impression cylinder and intended to print the substrate with an ink containing pigments that can be orientated by a magnetic field and an unloading system for carrying the substrate away. The impression cylinder comprises at least one magnetic element on its impression surface, said magnetic element being positioned at a point corresponding to said impression performed by said screen on said substrate.

17 Claims, 7 Drawing Sheets

PRINTING MACHINE

CROSS REFERENCE TO RELATED APPLICATIONS

This application is a continuation of co-pending U.S. application Ser. No. 10/561,748, which is the National Stage of International Application No. PCT/IB04/02144, filed Jun. 29, 2004, the entire disclosures of which are incorporated herein by reference.

TECHNICAL FIELD

The present invention relates to a sheet-fed or web-fed printing machine, to a printing method and to a security element for paper securities.

BACKGROUND OF THE INVENTION

In the field of paper securities, particularly banknotes, there is an increasing need for security elements as protection against forgery. In the last few years, computers, scanners and photocopiers have undergone appreciable technical improvements and it is currently possible to purchase high-performance equipment at a reasonable price. As the performance of this equipment has become very good, it has become necessary to develop new security elements, which themselves also perform better, for paper securities such as banknotes, checks, credit cards, passports or identity documents and other similar documents so as to protect these documents against forgery and prevent them from being able to be copied by present-day computers, scanners and photocopiers.

Known security elements for combating forgery are, for example, formed of combinations of the superposition of lines and/or patterns with colors, which are visible only under certain conditions, for example under UV light, or when held up to the light. The benefit of such security elements is that they are easy to print or to place on the document that is to be protected and can be checked using simple equipment, even using the naked eye, but are impossible to reproduce using present-day printers, scanners and photocopiers.

DESCRIPTION OF THE PRIOR ART

By way of example, U.S. Pat. No. 6,050,606, incorporated by reference into this application, describes a security element for paper securities, for example for banknotes. This security element is formed with a background having at least two juxtaposed regions, each region comprising its own geometric designs, said regions having a different color density. The security element further comprises a pattern corresponding to the region of lowest color density which is printed in superposition on said region in a color chosen so as to compensate for the difference in color density between said two regions. Thus, the security element appears uniform and patternless to the naked eye, but the pattern becomes clearly visible if said element is photocopied.

U.S. Pat. No. 5,443,579, incorporated by reference into this application, describes another method for printing a latent image on a substrate. According to that patent, the printing of lines in relief is combined with the printing of lines without relief. Thus, a latent color image is created that cannot be reproduced with a photocopier or other photomechanical methods.

U.S. Pat. No. 5,853,197 and U.S. Pat. No. 5,487,567, incorporated by reference into this application, display security elements which are not easily visible to the naked eye but which, by contrast, become clearly evident when the element is reproduced by photocopying or scanning.

Another specific technique employs watermarks in which the substrate, for example, paper, is marked with lines or a pattern which are visible only when held up to the light. Another development of this technique relates to pseudo-watermarks formed by the creation of a window in the substrate, this technique being used in particular with paper substrates which are not themselves normally transparent, said window for its part being transparent.

U.S. Pat. No. 6,082,778, the content of which is incorporated by reference into this application, describes an identity card protected against unauthorized copying by photocopiers. In that patent, the idea is to create a security element by combining the protective effect afforded by a thin film of metal with the physical, particularly optical, properties of an additional layer, the combination of the effects of which prevents the card from being reproduced. Under a transparent cover layer there is a layer of metal over the top of a layer having specific optical properties. In a first embodiment, the metal layer is locally demetalized thus exposing the layer with specific optical properties, that is to say rendering it visible in the demetalized zone. The difference in contrast between the layers renders the marks formed by demetalization easy to recognize with the naked eye. In one particular embodiment, the layer with specific optical properties has a dark color, for example is black. The combination of direct reflection of the metalized zone and of a layer with high absorption (black layer) prevents the difference in contrast from being detected such that the information formed by the demetalization completely disappears on a copy of this security element.

In another embodiment, the layer with specific optical properties contains fluorescent or phosphorescent substances which, when irradiated with the light of a photocopier, do not emit any light at a wavelength in the visible spectrum, which means that that zone is not reproduced either.

According to other techniques known in the state of the art, use is made of a laser either to mark the substrate directly or to mark a layer applied to said substrate and thus create security elements that are impossible to reproduce using a photocopier or scanner.

Other security elements use optically variable devices ("OVDs"®) in the form of metalized patches (known as "foils") or holograms and also moirés and other similar patterns, all of these being, on the one hand, very difficult if not impossible to copy with current equipment but also, on the other hand, very easy to check visually using appropriate means or with the naked eye.

It is also known practice to use special inks such as optically variable inks for printing particular patterns or geometric shapes on the paper security substrate. These inks, known per se in the state of the art, contain pigments with a varying optical effect and change color according to the angle from which they are viewed. By way of example, publications US 2002/0160194 A1, US 2002/0182383 A1 and EP 1 239 307 disclose such inks and their contents are incorporated by reference into this application inasmuch as they describe the principle and composition of such inks.

When such inks are used, it has been found that the pigments with a varying optical effect containing an additional magnetic layer could be orientated by the application of a magnetic field, thus creating particular effects. This particular technique is described in publications U.S. Pat. No. 6,103,361, U.S. Pat. No. 5,630,877, WO 03/000801 and U.S. Pat. No. 5,364,689 and incorporated by reference into this application.

However, one of the problems encountered when printing with optically variable ink lies in the fact that this ink is often used to print the value of the paper security (e.g. banknote), this value being generally indicated parallel to the length of the banknote. In addition, there is still a search to create an optical effect that is visible when the paper security is turned about an axis parallel to the length of said paper security (up-down movement) rather than an axis parallel to the width (left-right) movement, the first movement being more intuitive to a user.

Conventionally, the sheets bearing impressions of paper securities arranged in matrix form move in the widthwise direction of said impressions so that the integration of stationary magnets in a conventional printing machine entails a movement parallel to the width of the impressions in order to create a visible effect (the left-right movement mentioned above). Creating an effect in the desired direction (the up-down movement mentioned above) entails change to the direction of travel of the sheets if the particular effect is to be obtained in the desired direction (the up-down movement mentioned above). Thus, existing machines need to be modified significantly, and this is of little economic benefit and increases the time needed for printing.

Hence, one object of the invention is to improve the known methods and devices.

SUMMARY OF THE INVENTION

Another object of the invention is to propose a printing machine and a method employed by this machine that increases the security of the printing.

More specifically, it is an object of the invention to propose a printing system, particularly for paper securities, that can be incorporated into existing machines in a simple way.

Another object of the invention is to make available a particular printing method for paper securities.

An additional object of the invention is to propose an improved security element.

The invention is defined by the characteristics of the claims.

DESCRIPTION OF THE DRAWINGS

The invention will be better understood from the description of several embodiments thereof and by reference to the attached drawings, in which.

DESCRIPTION OF THE PREFERRED EMBODIMENTS

Figure 1:
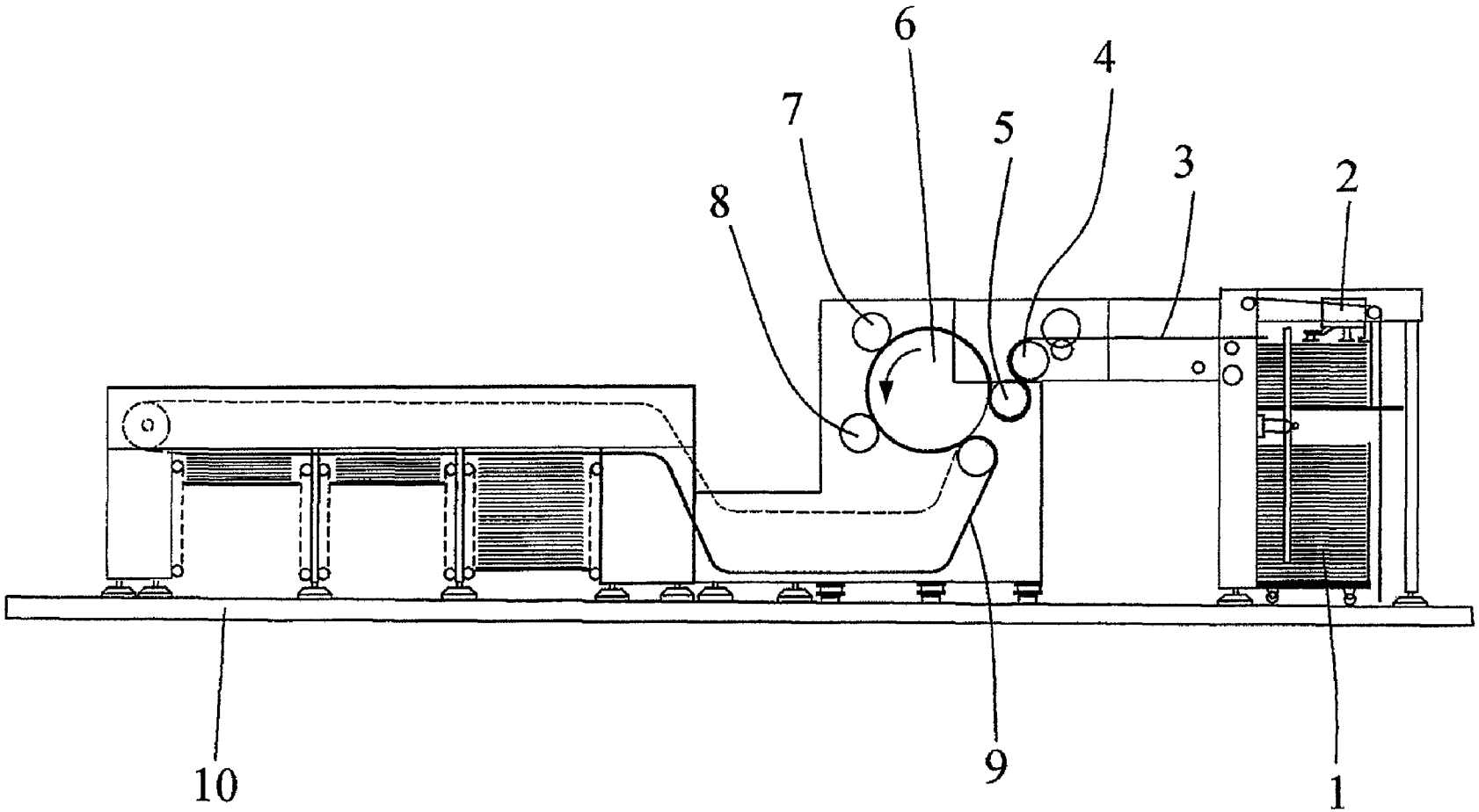
FIG. 1 shows a schematic depiction of a screen-printing machine.

A conventional sheet-fed printing machine is described first of all with reference to FIG. 1. This known machine was described in detail in U.S. Pat. No. 6,109,172 and its content is incorporated by reference into this application inasmuch as regards the operating principle of a screen-printing machine. The machine comprises a magazine 1 containing sheets for printing, a feed device 2 for successively transferring sheets along the path 3 toward a feed cylinder 4, a transfer cylinder 5 for conveying the successive sheets onto an impression cylinder 6, two screen cylinders 7 and 8 with doctor blades and collaborating with the impression cylinder 6 and a chain gripper system 9 which, once the sheets have been printed, transports the sheets to outlet magazines 10.

Since the machine comprises two screen cylinders 7 and 8 with doctor blades 55, 56, it is capable of screen-printing in two colors on the successive sheets. On the impression cylinder 6 the sheets pass first of all over the first screen cylinder 7, where they are screen-printed in a first color, then they pass over the second screen cylinder 8 where they are screen-printed in a second color. This second impression may be printed in a different zone to the impression printed by the first screen cylinder 7 or in the same zone. In the latter instance, it is necessary to add a system for drying the ink deposited by the first screen cylinder 7, for example UV lamps or some other equivalent system.

Figure 2:
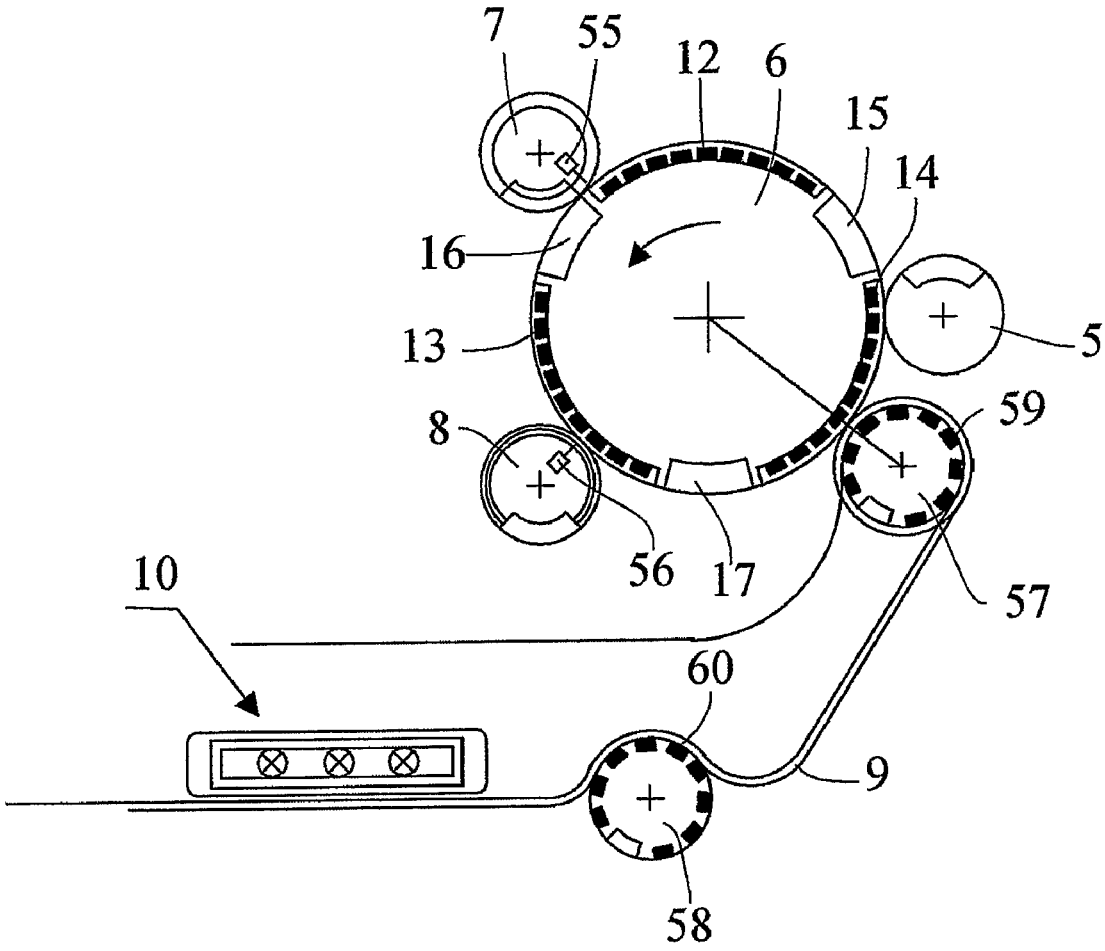
FIG. 2 shows one embodiment of an impression cylinder according to the invention.

FIG. 2 shows an impression cylinder 6 in section according to the present invention in the configuration of FIG. 1, namely surrounded by a feed cylinder, two screen cylinders 7 and 8, an unloading system 9, for example a gripper chain, and a drying system 10, for example UV lamps.

According to the invention, the impression cylinder 6 comprises a plurality of magnets 12, 13 and 14 placed in a distribution corresponding to the impressions on the substrate sheets, each set of magnets being separated by notches 15, 16, 17 in the impression cylinder 6, in which grippers for holding the sheets on the cylinder 6 are positioned. These magnets may be fixed to the cylinder by any appropriate means, particularly by bonding, screwing or some equivalent means.

According to a first variant of the invention, the magnetic elements 59 (for example magnets) are positioned not directly in the impression cylinder 6 but in an unloading cylinder 57.

According to a second variant of the invention, the magnetic elements 60 (for example magnets) are placed in an intermediate cylinder 58 situated between the unloading cylinder and the UV lamps 10, in the direction of travel of the substrate.

According to another variant, the magnets are positioned both in the impression cylinder 6 and/or in the unloading cylinder 57 and/or in the intermediate cylinder 58.

The benefit of the two variants is that they make it possible to keep a conventional impression cylinder without the risk of creating lumps or recesses in the impressions as a result of an uneven surface of the impression cylinder 6.

Figure 3A:
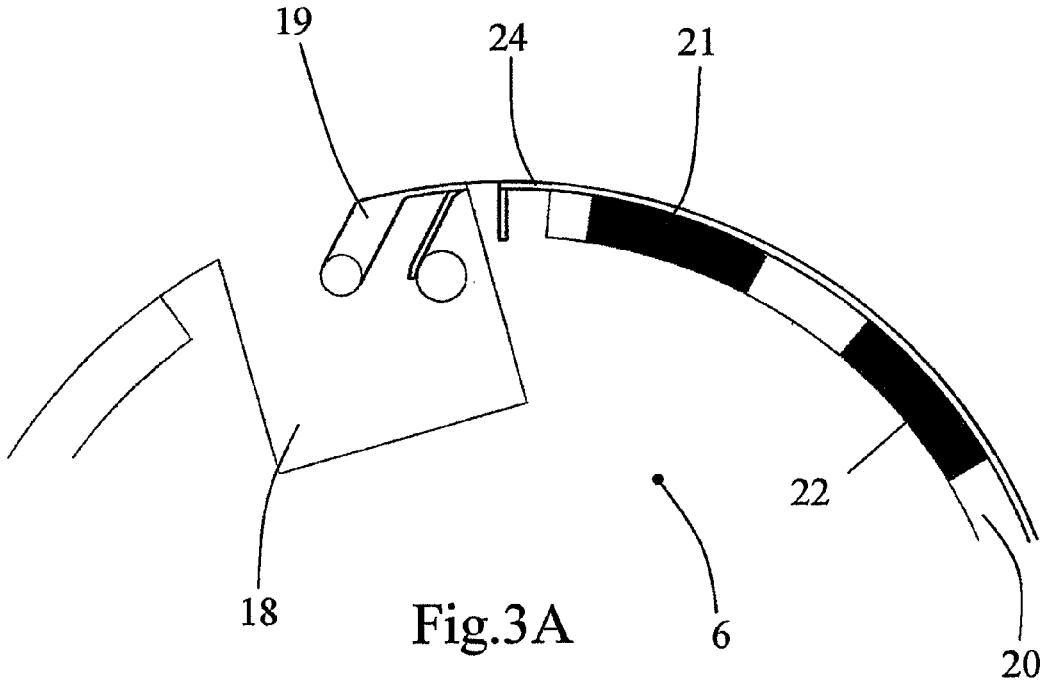
FIGS. 3A and 3B show two variants of the embodiment of FIG. 2.
Figure 3B:
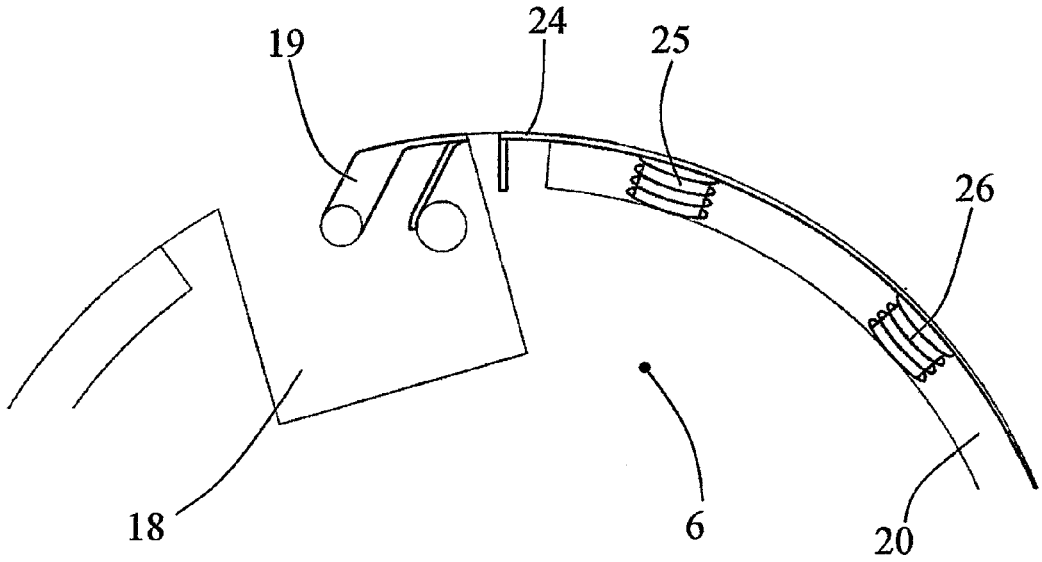

FIGS. 3A and 3B schematically depict two partial views of an impression cylinder with two variants of magnets. In the first variant (FIG. 3A), the impression cylinder 6 comprises at least one notch 18 in which the gripper system 19 holding the substrate 1 which is being printed is located.

The cylinder comprises in addition a second notch 20 in which magnets 21, 22 are positioned in a distribution corresponding to that of the impressions on the substrate (not depicted). The magnets 21, 22 are covered by a sheet 24 of nonmagnetic material, for example of aluminum or stainless steel. In this variant, the magnets 21, 22 are permanent magnets.

In the variant of FIG. 3B, the identical elements are referenced in the same way as in FIG. 3A, and the difference is in the means used by way of magnets. In this variant, use is made of coils 25, 26.

The principles set out with reference to FIGS. 3A and 3B in the case of the impression cylinder 6 apply of course in the same way to the variants of the invention indicated hereinabove, when it is the unloading cylinder 57 and/or the intermediate cylinder 58 which supports the magnetic elements.

Figure 4:
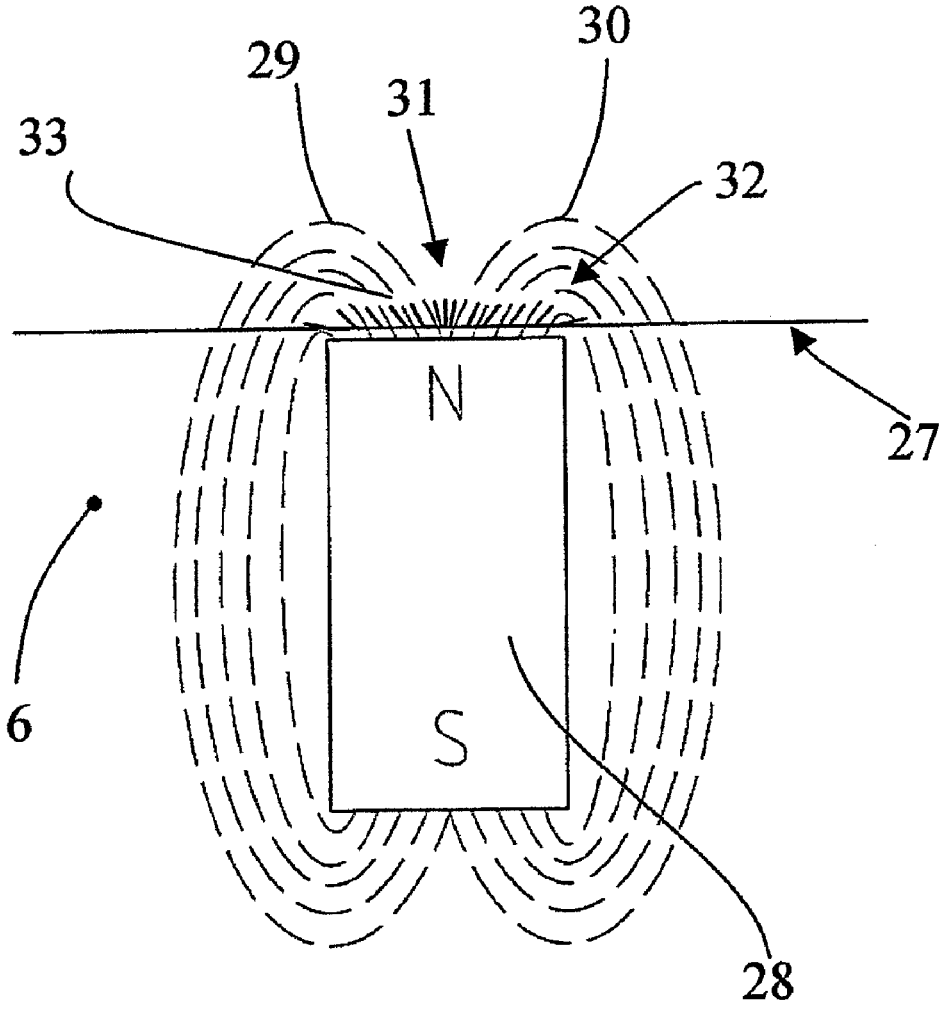
FIG. 4 shows an operating diagram for the effect obtained by the invention.

The principle used in the present invention is shown schematically in FIG. 4. This figure depicts a substrate 27, for example a sheet of paper, on which an impression of optically variable ink has been deposited. The impression cylinder 6 comprises, as depicted, a permanent magnet 28 which creates magnetic field lines 29, 30 depicted in this figure. Furthermore, since the optically variable ink contains magnetic pigments of varying optical effect, the magnetic field lines 29, 30 will orientate these pigments in the directions indicated in this FIG. 4. In a central zone 31, the pigments will be aligned vertically whereas in the lateral zones 32 and 33, the pigments will adopt a more horizontal configuration, as depicted. Thus, according to the angle from which the impression is viewed, the apparent color of the impression will change and a change in orientation will have a dynamic result on the impression with changes in color followed in the impression.

One of the advantages of the system according to the invention is that since the sheet is stationary with respect to the magnets, the abovementioned problem associated with the habitual direction of travel of the sheets with respect to the direction in which the optical effect is to be created is avoided. It is now possible to create this effect without changing the directions of travel of the successive sheets, or even, on one and the same sheet, to create security elements with optical effects in different directions (which may or may not be mutually perpendicular) with no influence over the direction of travel of the successive sheets or the need to print successive impressions using optically variable ink.

Figure 4A:
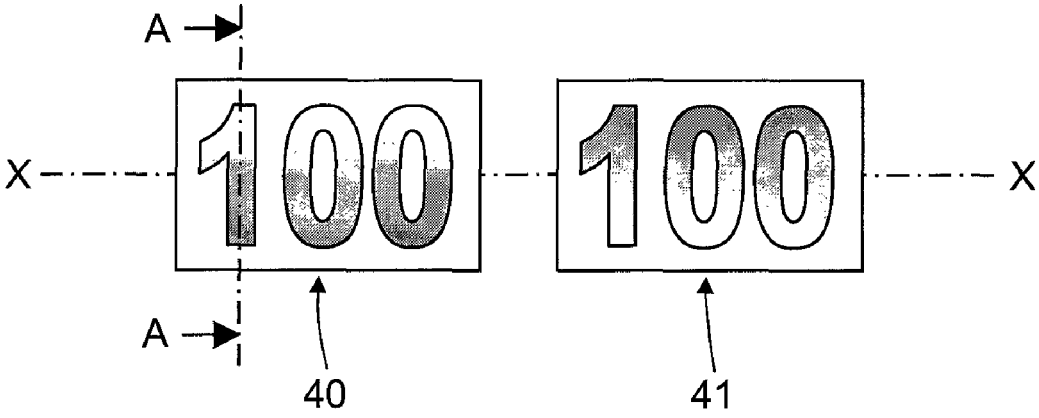
FIGS. 4A and 4B schematically show a first configuration of orientation of magnetic pigments of varying optical effect.
Figure 4B:
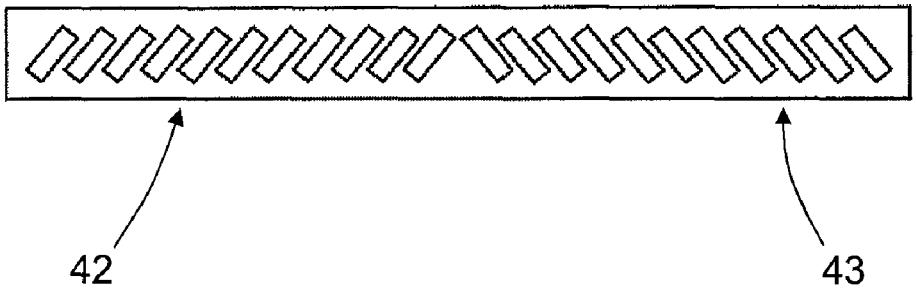

FIGS. 4A and 4B show a first optical effect that can be obtained with the machine according to the invention. In FIG. 4A, an impression 40 in ink containing magnetic pigments with a varying optical effect forms the numeral "100". In order to depict the obtained effect correctly, the upper half of this impression 40 is paler and its lower half is darker.

The impression 41 in FIG. 4A depicts the same impression as the impression 40 but having undergone rotation about the axis X so as to vary the angle from which the impression is viewed. From this position, it is now the lower half which is paler and the upper half which is darker.

In order to obtain this effect, the pigments are oriented by means of a magnet as in the section A-A depicted in FIG. 4B, that is to say approximately at 45° in the left-hand part 42 and approximately at 135° in the right-hand part 43.

Thus, by rotating in both directions about the axis X, a determined variation in the colors in the two halves of the impression is obtained and results in a dynamic optical effect that is impossible to copy using conventional means such as scanners or photocopiers.

A second optical effect that can be created with the invention is described with reference to FIGS. 5A and 5B. The impression 44 forms the numeral "100" and comprises a lighter zone in its upper part. By turning the impression about the axis X, the lighter zone then moves within the impression, as shown in the impressions 45 and 46, to move into the central part of the impression (impression 45) and into the lower part thereof (impression 46).

Figure 5A:
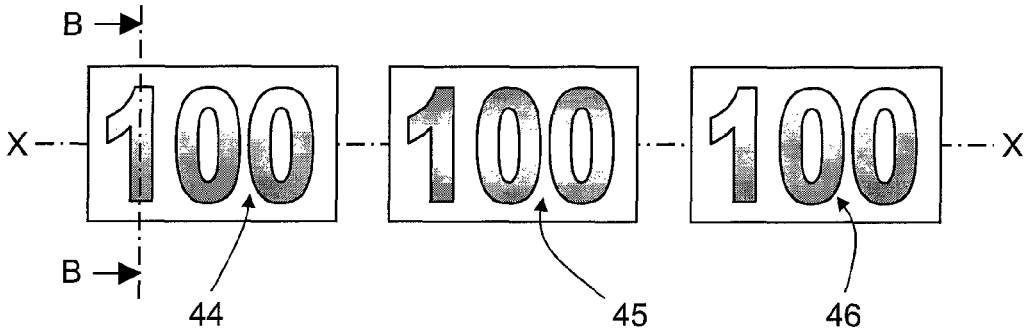
FIGS. 5A and 5B schematically show a second configuration of orientation of magnetic pigments of varying optical effect.
Figure 5B:
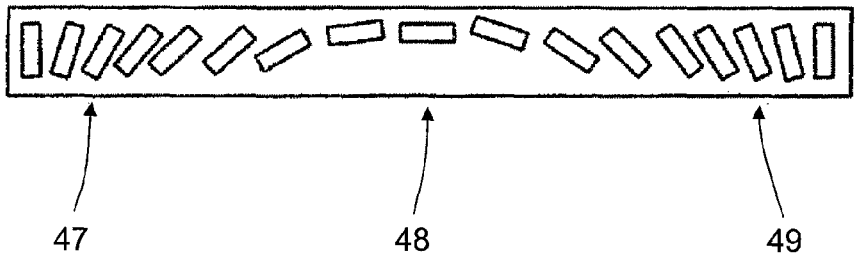

This optical effect is obtained by orientating the pigments as depicted in FIG. 5B which corresponds to section B-B of FIG. 5A. As depicted (from left to right), the pigments are first of all orientated practically vertically (zone 47) then gradually arrive in horizontal orientation (zone 48) then finally return to a practically vertical orientation (zone 49).

Thus, by rotations in two directions about the axis X, the visual effect of a movement of a pale zone within the impression is obtained and this results in a dynamic optical effect that is impossible to copy by photocopying or scanning.

Figure 6A:
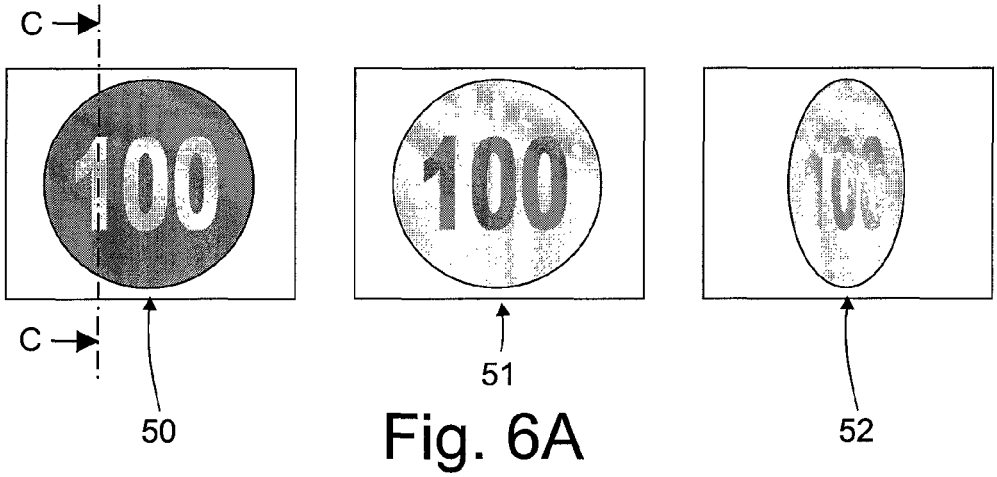
FIGS. 6A and 6B schematically show a third configuration of orientation of magnetic pigments of varying optical effect.
Figure 6B:
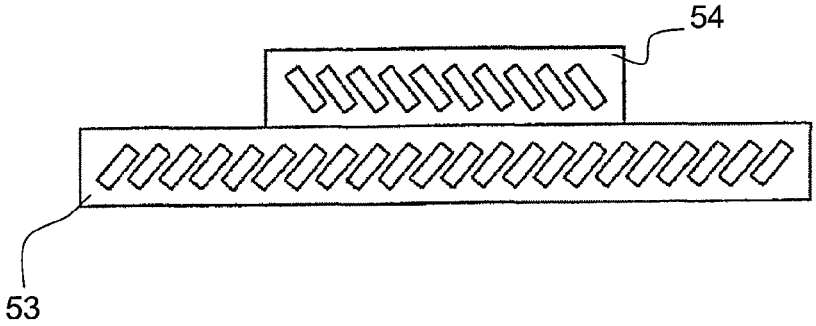

A third optical effect is depicted in FIGS. 6A and 6B. This effect is obtained by two superposed impressions created using the same optically variable ink. When the impression is viewed at right angles (impression 50), the impression is bright and the background is matt. If the impression is turned in any direction whatsoever there is then a reversal of the bright and matt zones (impression 51). In addition, if the orientation is changed laterally (impression 52), a variation in color is also obtained.

These optical effects are obtained by the impressions as depicted in the section C-C of the FIG. 6B in which there is a first layer 53 with pigments orientated in a first direction and a second layer 54 with pigments orientated in a second direction, the two directions being different. These layers are deposited successively on the substrate and the first layer 53 has to be dried before the second is deposited, so as to maintain the orientation of the pigments in said first layer.

The invention is not restricted to the embodiments described but variations can be made within the scope of the claimed protection. For example, the screen may be borne by a cylinder (as in the machine of FIGS. 1 and 2) or may also be flat.

Various types of ink are also possible, provided that they contain magnetically orientable pigments.

The invention claimed is:

1. A screen printing machine for printing a substrate in the form of a sheet or continuous web bearing impressions of security papers arranged in matrix form, comprising:

a transfer system for conveying the substrate onto an impression cylinder;

at least a first screen cylinder cooperating with the impression cylinder for applying a plurality of first ink patterns on the substrate, which first ink patterns are arranged in a matrix form corresponding to that of the security papers, the first ink patterns being made of a first optically variable ink containing magnetically orientable pigments;

an unloading system for carrying the substrate away from the impression cylinder after printing by the first screen cylinder;

a drying system for drying the first ink patterns applied on the substrate; and a first cylinder carrying a plurality of magnetic elements which are arranged in a matrix form corresponding to that of the first ink patterns, each magnetic element being designed to orient the magnetically orientable pigments contained in the first ink patterns before the first ink patterns are dried by the drying system, the first cylinder carrying the plurality of magnetic elements and the impression cylinder are the same cylinder;

a second screen cylinder cooperating with the impression cylinder, downstream of the first screen cylinder, for applying a plurality of second ink patterns on the substrate, which second ink patterns are arranged in a matrix form corresponding to that of the security papers, the second ink patterns being made of a second optically variable ink containing magnetically orientable pigments; and a second cylinder, located downstream of the impression cylinder, carrying a plurality of magnetic elements which are arranged in a matrix form corresponding to that of the second ink patterns, each magnetic element being designed to orient the magnetically orientable pigments contained in the second ink patterns according to a determined orientation before the second ink patterns are dried by the drying system.

2. The screen printing machine in accordance with claim 1, wherein the second cylinder carrying the plurality of magnetic elements is an unloading cylinder of the unloading system, which unloading cylinder is located upstream of the drying system.

3. The screen printing machine in accordance with claim 1, wherein the second cylinder carrying the plurality of magnetic elements is an intermediate cylinder placed along the path the unloading system, which intermediate cylinder is located upstream of the drying system.

4. The screen printing machine in accordance with claim 1, wherein said first and second ink patterns are applied in a same zone and wherein said screen printing machine further comprises an intermediate drying system for drying the first ink patterns before application of the second ink patterns.

5. The screen printing machine in accordance with claim 1, wherein the plurality of magnetic elements of the first cylinder are covered by a sheet of nonmagnetic material.

6. The screen printing machine in accordance with claim 5, wherein the sheet of nonmagnetic material is made of aluminum or stainless steel.

7. The screen printing machine in accordance with claim 1, wherein the plurality of magnetic elements of the second cylinder are covered by a sheet of nonmagnetic material.

8. The screen printing machine in accordance with claim 7, wherein the sheet of nonmagnetic material is made of aluminum or stainless steel.

9. The screen printing machine in accordance with claim 1, wherein the plurality of magnetic elements of the first cylinder are permanent magnets.

10. The screen printing machine in accordance with claim 1, wherein the plurality of magnetic elements of the second cylinder are permanent magnets.

11. The screen printing machine in accordance with claim 1, wherein the plurality of magnetic elements of the first cylinder are designed so that the magnetically orientable pigments of a first half of each first ink pattern are oriented in a first direction and the magnetically orientable pigments of a remaining half of each first ink pattern are oriented in a second direction distinct from the first direction.

12. The screen printing machine in accordance with claim 1, wherein the plurality of magnetic elements of the first cylinder are designed so that the orientation of the magnetically orientable pigments of each first ink pattern gradually changes from a practically vertical orientation to a horizontal orientation and vice versa.

13. The screen printing machine in accordance with claim 4, wherein the plurality of magnetic elements of the first cylinder are designed so that the magnetically orientable pigments of each first ink pattern are oriented in a first direction, and wherein the plurality of magnetic elements of the second cylinder are designed so that the magnetically orientable pigments of each second ink pattern are oriented in a second direction distinct from the first direction.

14. The screen printing machine in accordance with claim 1, wherein the plurality of magnetic elements of the first cylinder are designed so that the magnetically orientable pigments of each first ink pattern are oriented in a direction which is perpendicular to a direction of travel of the substrate.

15. The screen printing machine in accordance with claim 1, wherein the plurality of magnetic elements of the first cylinder are designed so that the magnetically orientable pigments of each first ink pattern are oriented in a direction which is parallel to a direction of travel of the substrate.

16. The screen printing machine in accordance with claim 1, wherein the plurality of magnetic elements of the second cylinder are designed so that the magnetically orientable pigments of each second ink pattern are oriented in a direction which is perpendicular to a direction of travel of the substrate.

17. The screen printing machine in accordance with claim 1, wherein the plurality of magnetic elements of the second cylinder are designed so that the magnetically orientable pigments of each second ink pattern are oriented in a direction which is parallel to a direction of travel of the substrate.

* * * * *